US006340965B1

(12) United States Patent
Howard et al.

(10) Patent No.: US 6,340,965 B1
(45) Date of Patent: Jan. 22, 2002

(54) MODIFIABLE DISPLAY HAVING FIXED IMAGE PATTERNS

(75) Inventors: Matthew E. Howard, San Francisco; David K. Biegelsen, Portola Valley; Daniel G. Bobrow, Palo Alto; L. Charles Hebel, Cupertino; Jock D. Mackinlay, Palo Alto; Nicholas K. Sheridon, Los Altos; Alexander E. Silverman, Menlo Park, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/271,373

(22) Filed: Mar. 18, 1999

(51) Int. Cl.[7] ..... G09G 3/34

(52) U.S. Cl. ..... 345/107; 345/84; 345/85; 345/86; 345/111; 345/88; 359/296; 359/298

(58) Field of Search ..... 345/107, 111, 345/87, 84, 85, 88; 359/296, 298

(56) References Cited

U.S. PATENT DOCUMENTS

| | | | | | |
|---|---|---|---|---|---|
| 4,126,854 | A | | 11/1978 | Sheridon | 345/107 |
| 5,389,945 | A | | 2/1995 | Sheridon | 345/107 |
| 5,604,027 | A | | 2/1997 | Sheridon | 345/107 |
| 5,717,514 | A | | 2/1998 | Sheridon | 345/107 |
| 5,815,306 | A | * | 9/1998 | Sheridon et al. | 345/107 |
| 5,982,346 | A | * | 11/1999 | Sheridon et al. | 345/88 |

FOREIGN PATENT DOCUMENTS

| | | | | |
|---|---|---|---|---|
| WO | WO 91/15843 | * | 4/1990 | 345/904 |

* cited by examiner

*Primary Examiner*—Xiao Wu
*Assistant Examiner*—Ali Zamani
(74) *Attorney, Agent, or Firm*—Oliff & Berridge, PLC

(57) ABSTRACT

Selected regions of an electronically modifiable display are fixed while other regions are left electronically modifiable. The selected regions are fixed by various methods including subjecting the selected regions to heat, light or pressure. In some embodiments, the fixed regions are reversibly fixed so that changes can be made to the fixed regions.

31 Claims, 6 Drawing Sheets

MODIFIABLE DISPLAY HAVING FIXED IMAGE PATTERNS

BACKGROUND OF THE INVENTION

1. Field of Invention

This invention relates to modifiable displays with a plurality of stable display states and, more specifically, fixing regions of such modifiable displays to create displays with both fixed and changeable regions.

2. Description of Related Art

FIG. 1 shows one type of modifiable display with a plurality of stable display states. This type of modifiable display is a type of electric paper called the Gyricon. In FIG. 1, electric paper 1 consists of a polymer substrate 10 with elements 20 embedded that are one color, for example, white 30, on one side and another color, for example, black 40, on the other. Such electric paper is described in U.S. Pat. No. 5,604,027, incorporated herein by reference. Under the influence of an electric field, each element rotates so that either one colored side or the other is on top and, therefore, visible to a viewer viewing the electric paper from the top. The elements in this example have two stable states, but the elements can have more than two stable states. The stable state in which each element exists remains unchanged until the element is subjected to the electric field associated with a different stable state. In addition, the elements can be multicolored as discussed, for example, in U.S. Pat. No. 5,717,514, incorporated herein by reference, or cylindrical as discussed, for example, in pending U.S. patent application Ser. No. 08/960,865 entitled "TWISTING CYLINDER DISPLAY" filed Oct. 30, 1997, and pending U.S. patent application Ser. No. 08/960,868 entitled "A TWISTING CYLINDER DISPLAY USING MULTIPLE CHROMATIC VALUES" filed Oct. 30, 1997, incorporated herein by reference. FIG. 6 shows a cross sectional view of an example of electric paper. In FIG. 6, an element 20 is suspended in oil in a cavity 22 of elastomer 50. Elastomer 50 and element 20 are contained within an upper protective layer 60 and a lower protective layer 70. Because element 20 is suspended in oil within cavity 22, element 20 can freely rotate when subjected to an electric field.

Printing on this form of electric paper is accomplished by imposing an electrical pattern over the sheet, the electrical pattern being created by a voltage difference between the top side of the sheet and the bottom side of the sheet. As shown in U.S. Pat. No. 5,389,945, one way to do this is to pass the sheet under an imagewise charging bar. As the sheet passes under the bar, voltages are applied along a set of closely-spaced electrical contacts, one for each pixel or element.

While one kind of electric paper is described above, many kinds of electric paper are known. In addition, other kinds of modifiable displays such as, for example, electrophoretic displays (both single cell type and micro capsule type), thermally addressable displays, magnetically addressable displays and certain kinds of liquid crystal displays, are known.

While conventional electric paper is useful due to its ability to be erased and reused, its erasable property results in added steps being required to use the electric paper as a form (e.g., a form to be filled out by a user). In order to use conventional electric paper as a reusable form, after every erasure, the background or common portions of the form must be rewritten to the electric paper. This step of rewriting the background or common portions is necessary because these portions are erased along with the unique portions.

SUMMARY OF THE INVENTION

This problem is addressed by the invention by physically fixing a portion of the modifiable display that is common to all uses of that display such that normal erasure of the display will not erase the physically fixed portions. In the case of a form, the common portions could include, for example, grid lines, headings and labels such as "Name" for blocks to be filled in by a user of the form.

The present invention physically fixes selected regions of the display while leaving the remainder modifiable. The selected regions can be physically fixed in a number of ways. For example, the elements in the selected regions can be heated. By heating the selected regions, the elements in the selected regions can be disabled by, for example, applying an electrical field while the rotatable elements are heated above their melting temperatures, causing them to deform against the cavity wall and thus be no longer capable of rotation. Heating the selected regions can also cause chemical damage which can destroy the mechanisms by which the display operates. Still further damage can be effected by localized heating in which the local optical properties of the display material are changed by the introduction of changes in light absorption or scattering. An example of this is a decomposition of a hydrocarbon material in which a gas bubble is formed which causes scattering of incident light, or, in the case of the Gyricon, greatly interferes with the rotation of the balls. Fixing heat can be applied by using a laser, LED bar or the like. Pressure fixing can also be used to fix the selected regions by using an impact print head or bar to deform the elements or surrounding walls of the substrate. This will have the effect of damaging the rotatable elements, in the case of the Gyricon, and of, for example, destroying the alignment of the molecules at the window surfaces in the case of some liquid crystal kinds of electric paper.

Another aspect of the invention includes printing physically fixed information on the face of the display with standard marking technologies such as permanent ink pens, printers and photocopiers.

The physical fixing of the selected regions can be permanent or temporary. Methods for un-fixing previously fixed regions include removal of ink.

BRIEF DESCRIPTION OF THE DRAWINGS

The invention will be described in relation to the following drawings in which like reference numerals refer to like elements, and wherein:

FIG. 3 shows the display of FIG. 2 after being written on;

DETAILED DESCRIPTION OF PREFERRED EMBODIMENTS

Figure 1:
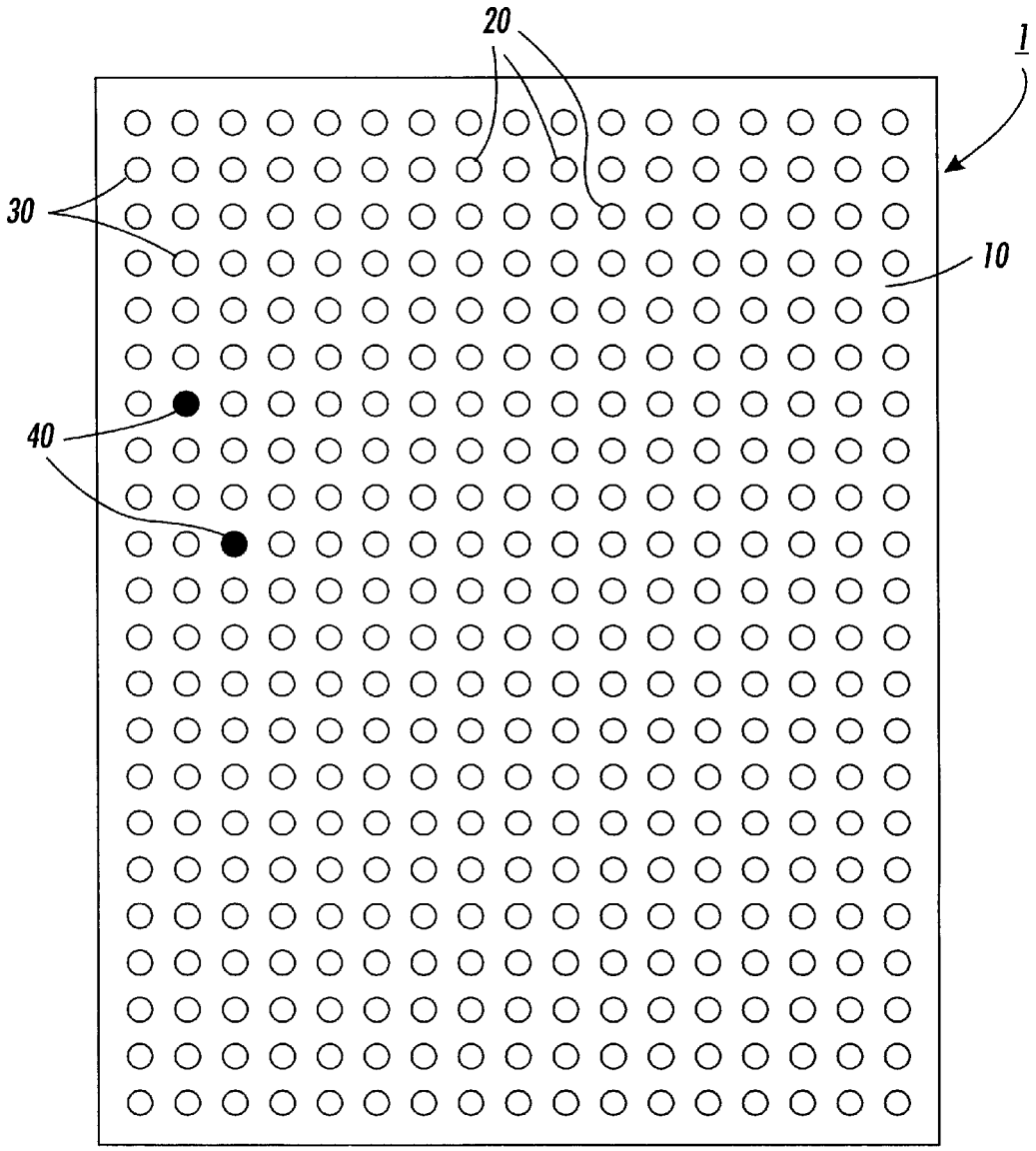
FIG. 1 shows a conventional piece of electric paper.
Figure 2:
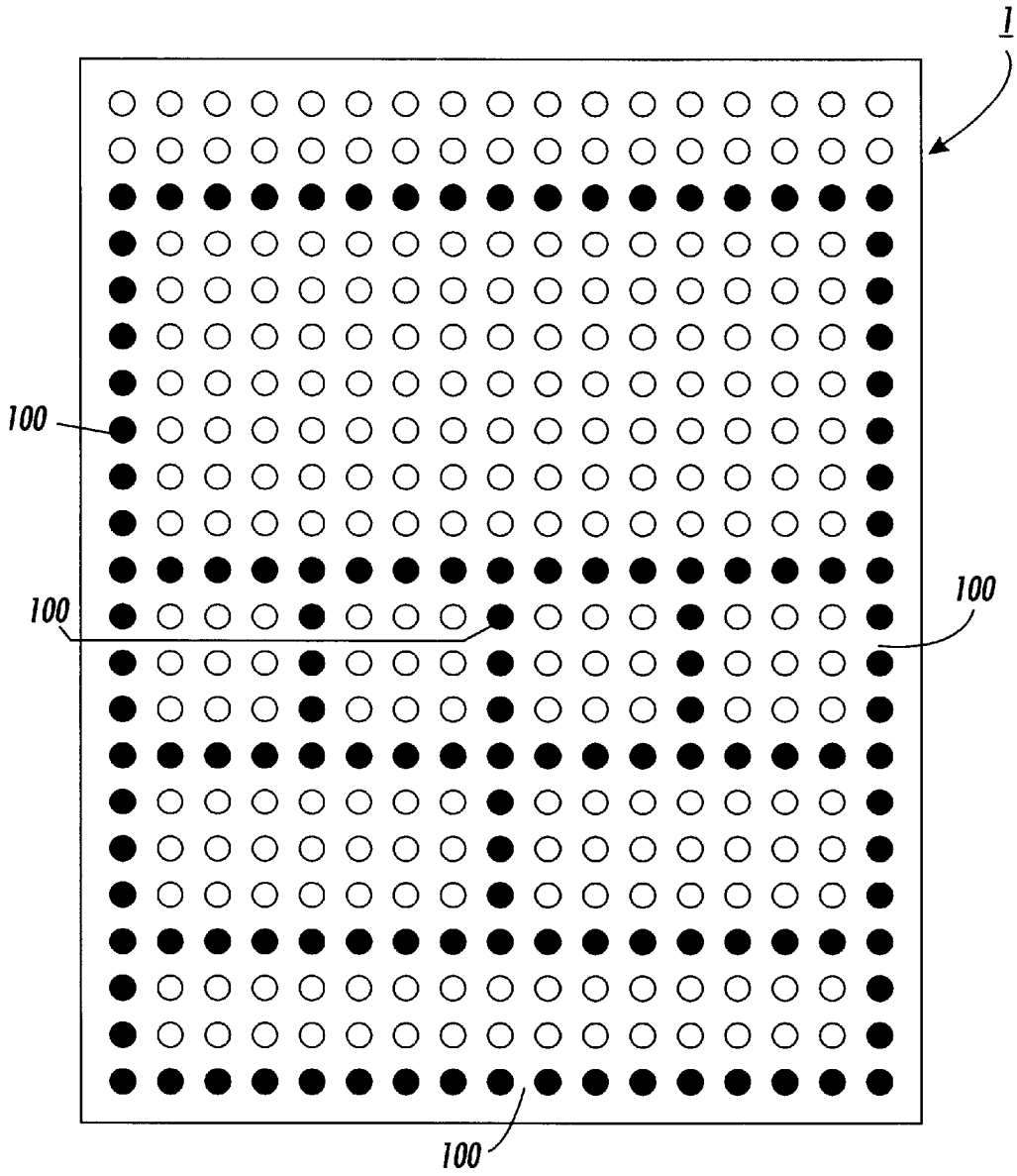
FIG. 2 shows one embodiment of a display of the present invention.

FIG. 2 shows an example of one embodiment of the present invention. In FIG. 2, grid or border lines 100 are shown on a rotating element display 1. All of the Figures represent the elements 20 of the rotating element display by a matrix of circles. For the purpose of illustration, the circles or elements 20 are shown separated by a relatively large distance. However, in an actual rotating element display or other modifiable display, the elements or pixels are spaced very close together (currently several hundred per inch). Therefore, while the examples shown in the Figures are very simple, very detailed fixed regions are possible with an actual modifiable display.

The elements 20 of the fixed regions 100 are first rotated by conventional methods so that their black side 40 is up. The selected regions 100 are then subjected to one of several physical fixing procedures.

Where the modifiable display is a rotating element display, physical fixing can be performed by the application of heat to the elements in the region to be fixed. The fixing heat can be applied in many ways. For example, light emitted from a laser or a powerful arc lamp can be used to, for example, fuse the selected elements to the substrate, deform the substrate surrounding the element in order to prevent the element from rotating or deform the element itself to prevent the element from rotating. Also, heat can be used to stimulate a chemical reaction within the element to turn the entire element a certain color. Conductive heating can also be used to supply the heat to perform the physical fixing described above.

Figure 7:
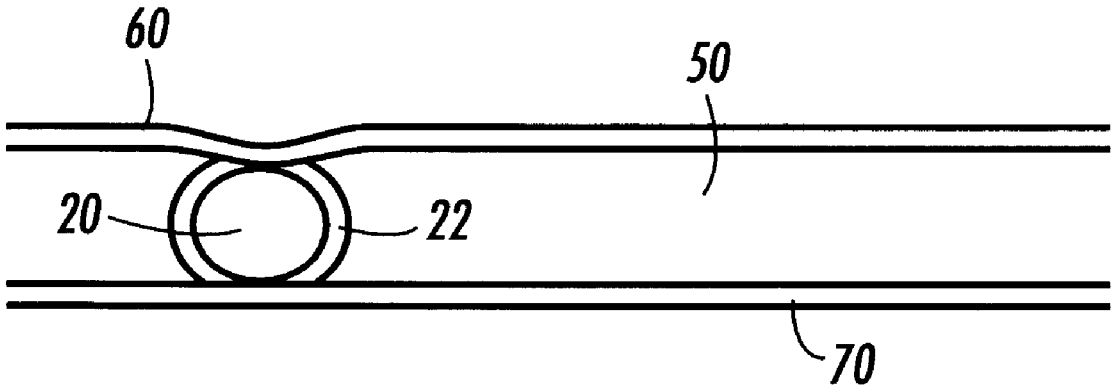
FIG. 7 shows the electric paper of FIG. 6 after being subjected to pressure.

The elements can also be physically fixed through the application of physical pressure on the elements to deform the elements to the point that they no longer rotate in the substrate. As an alternative, or an addition to, deforming the elements, the substrate surrounding the elements can be deformed through the application of physical pressure, causing the cavities the rotatable elements are contained in to squeeze the rotatable elements and prevent their rotation, as shown in FIG. 7. The fixing pressure can be applied by, for example, an impact print head or bar.

Figure 3:
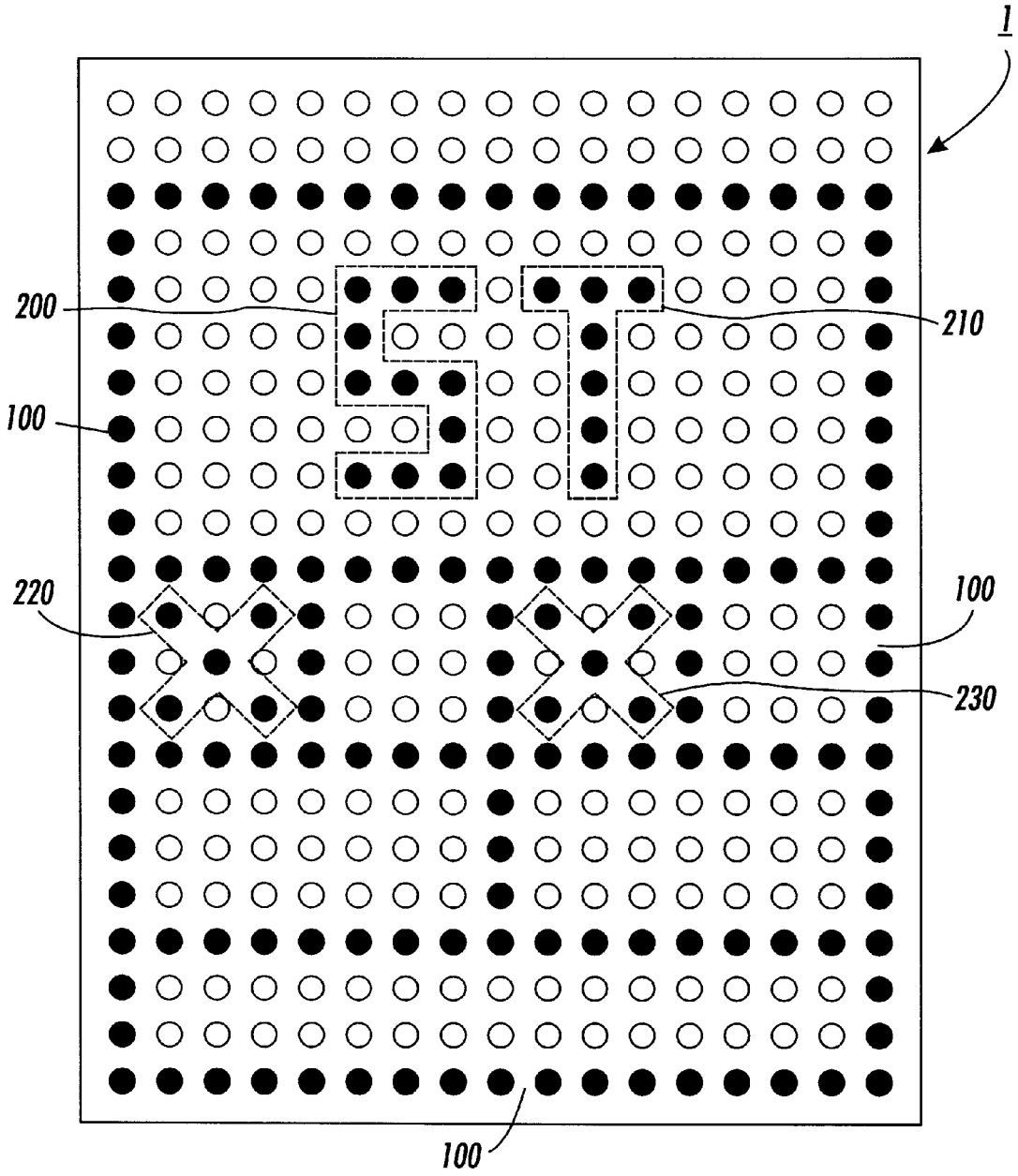
Figure 4:
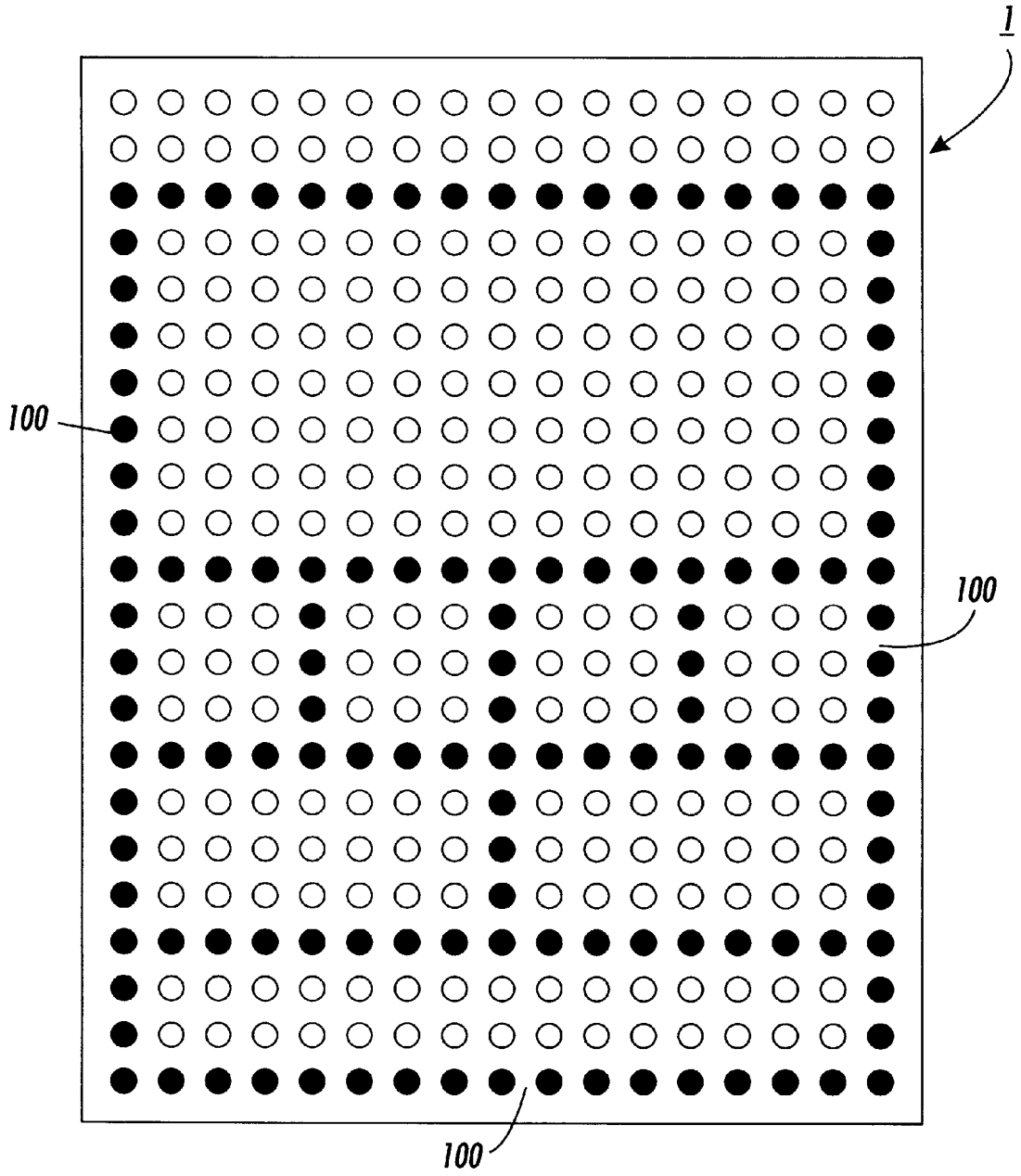
FIG. 4 shows the display of FIG. 3 after being erased.

FIG. 3 shows the form of FIG. 2 after being written on by a user of the form. The examples of user writings shown in FIG. 3 are initials "ST" 200, 210 and Xs 220, 230 (surrounded by dashed lines for clarity). These user writings are simple examples of user information written in non-fixed areas of a modifiable display form of the present invention. FIG. 4 shows the form of FIG. 3 after erasure of the user information 200, 210, 220, 230. As shown in FIG. 4, erasure of the form does not turn the fixed elements or pixels back to white. At this point, the form is ready for use by the next user.

Figure 5:
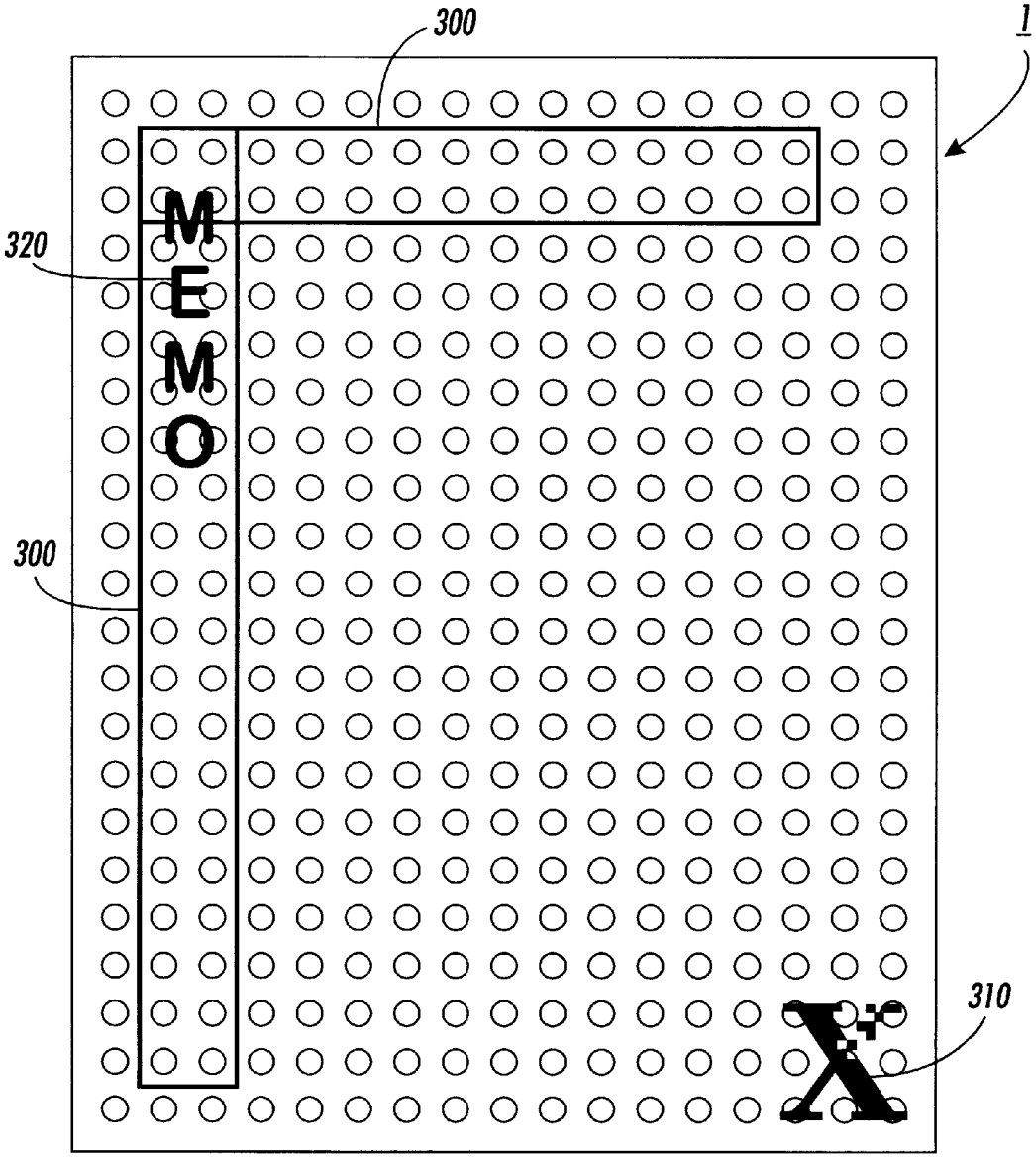
FIG. 5 shows another embodiment of the display of the invention.
Figure 6:
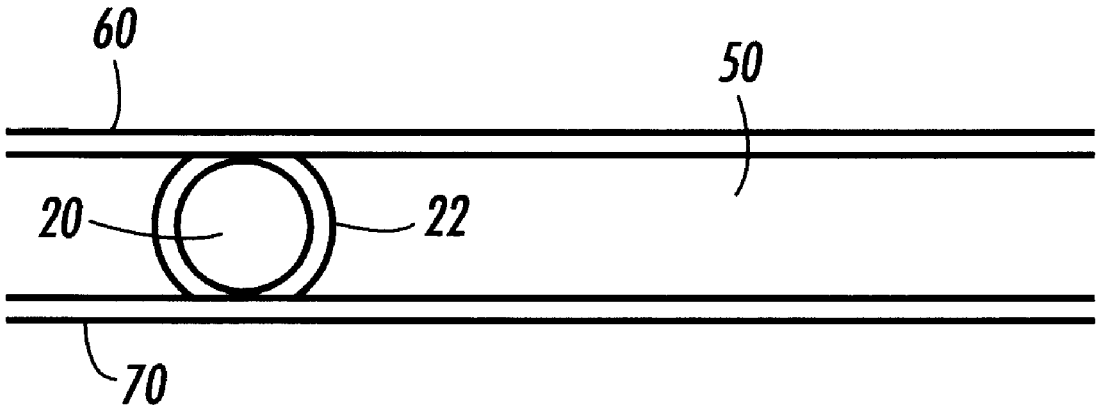
FIG. 6 shows a cross sectional view of an example of electric paper.

FIG. 5 shows another embodiment of the invention in which regions of the modifiable display, in this case electric paper, are provided with a certain color, in this case black, by printing on the face of the display with standard marking technologies such as permanent ink pens, printers and photocopiers. For example, the display can be put in a printer or copier in order to print or copy a form template onto the display. The ink or toner used during printing or copying can be soluble so that the image can be cleaned off and the display reused. This embodiment is not limited to reusable document applications in the office, but can also be utilized in large-area reusable display applications such as white boards, wall calendars, announcement boards, advertising boards and other types of signs. In FIG. 5, examples of fixed images are shown as boxes 300, logo 310 and heading 320.

While the above examples generally address permanent physical fixing of selected regions of the modifiable display, it is also possible to reversibly physically fix the selected regions. Thus the ink that was applied to the surface of the electric paper sheet can be removed by means of solvents or by heating it to its melting point and wiping it off, for example. In the case of the deformed substrate that in turn deformed the cavities containing the rotatable elements and prevented their rotation, thermal annealing could relieve the deformation, allowing the rotatable elements to again rotate in response to an electrical field.

Reversibly physically fixing regions permits the common areas of a form, for example, to be reformatted if necessary. This permits the reuse of displays, such as electric paper forms, after the format of the form or display is revised.

Many uses of physically fixing regions of a modifiable display become apparent from this application. Some examples of such uses are forms, stationery, notepads, display region boundaries, logos and glyph maps. This list includes only a very few examples of the large number of applications available for modifiable displays with physically fixed regions of the present invention and should not be considered as limiting.

While the invention has been described in conjunction with the specific embodiments described above, it is evident that many alternatives, modifications and variations will be apparent to those skilled in the art. Accordingly, the embodiments of the invention as set forth above are intended to be illustrative and not limiting. Various changes may be made without departing from the spirit and scope of the invention as defined herein. For example, the modifiable display can be electronically modifiable, magnetically modifiable, or otherwise modifiable.

What is claimed is:

1. A modifiable display with a plurality of stable display states, comprising:

a first set of elements switchable between a first state and a second state; and a second set of elements selectively physically fixed in the first state such that the second set of elements remains in the first state when subjected to any display signal, the second set of elements representing a desired image.

2. The display of claim 1, wherein the desired image is a pattern.

3. The display of claim 2, wherein the pattern includes portions of a form that are common to each use of the form.

4. The display of claim 1, wherein the display is an electronically sensitive display.

5. The display of claim 1, wherein the display is magnetically sensitive.

6. The display of claim 1, wherein the display is a rotating element display.

7. The display of claim 1, wherein the display is an electrophoretic display.

8. The display of claim 1, wherein the display is a liquid crystal display.

9. A method of fixing a region of a modifiable display having pixel elements, each pixel element having at least a first stable display state and a second stable display state, the method comprising:

controlling a first plurality of the pixel elements such that each of the first plurality of pixel elements is in the first stable display state; and selectively physically fixing the first plurality of the pixel elements representing a desired image in the first stable display state such that each of the first plurality of the pixel elements remains in the first stable display state when subjected to any display signal.

10. The method of claim 9, wherein a second plurality of the pixel elements is modifiable after each of the first plurality of the pixel elements is physically fixed.

11. The method of claim 10, wherein the first plurality of the pixel elements is physically fixed by heating the first plurality of the pixel elements.

12. The method of claim 10, wherein the first plurality of the pixel elements is physically fixed by heating the substrate.

13. The method of claim 10, wherein the first plurality of the pixel elements is physically fixed by subjecting the first plurality of the pixel elements to pressure.

14. The method of claim 10, wherein the first plurality of the pixel elements is physically fixed by a chemical reaction involving the first plurality of the pixel elements.

15. The method of claim 10, further comprising unfixing the first plurality of the pixel elements such that each of the first plurality of the pixel elements is modifiable.

16. The method of claim 15, wherein the first plurality of the pixel elements is unfixed by heating the first plurality of the pixel elements.

17. The method of claim 15, wherein the first plurality of the pixel elements is unfixed by a chemical reaction involving the first plurality of the pixel elements.

18. The method of claim 9, wherein the display is a rotating element display.

19. The method of claim 9, wherein the display is an electrophoretic display.

20. The method of claim 9, wherein the display is a liquid crystal display.

21. The method of claim 9, wherein the display is an electronically sensitive display.

22. The method of claim 9, wherein the display is a magnetically sensitive display.

23. A modifiable display with a plurality of stable display states, comprising:

a first protective layer;

a second protective layer;

modifiable pixel elements located between the first protective layer and the second protective layer; and a desired printed pattern on the first protective layer that remains in at least one of the stable display states when subjected to any display signal.

24. The display of claim 23, wherein the printed pattern is printed by a printer.

25. The display of claim 23, wherein the printed pattern is photocopied onto the first protective layer.

26. The display of claim 23, wherein the printed pattern is printed by a hand operated device.

27. The display of claim 23, wherein the display is a rotating element display.

28. The display of claim 23, wherein the display is an electrophoretic display.

29. The display of claim 23, wherein the display is a liquid crystal display.

30. The display of claim 23, wherein the display is an electrically sensitive display.

31. The display of claim 23, wherein the display is a magnetically sensitive display.

* * * * *